US005542824A

United States Patent [19]

Lee

[11] Patent Number: 5,542,824

[45] Date of Patent: Aug. 6, 1996

[54] REFRIGERANT COMPRESSOR HAVING INTERCONNECTED MUFFLER SECTION

[75] Inventor: Sung-Tae Lee, Suwon, Rep. of Korea

[73] Assignee: Samsung Electronics Co., Ltd., Suwon, Rep. of Korea

[21] Appl. No.: 430,226

[22] Filed: Apr. 28, 1995

[30] Foreign Application Priority Data

Apr. 29, 1994 [KR] Rep. of Korea ..... 94-9295

[51] Int. Cl.[6] ..... F04B 39/00

[52] U.S. Cl. ..... 417/312; 181/403; 181/243; 181/246

[58] Field of Search ..... 417/312, 902; 181/403, 229, 240, 243, 246

[56] References Cited

U.S. PATENT DOCUMENTS

| | | | |
|---|---|---|---|
| Re. 33,902 | 4/1992 | Fritchman | 417/312 |
| 4,477,229 | 10/1984 | Kropiwnicki et al. | 417/902 |
| 4,582,468 | 4/1986 | Bar | 417/312 |
| 4,755,108 | 7/1988 | Todescat et al. | 417/312 |
| 4,759,693 | 7/1988 | Outzen | 417/312 |
| 4,784,581 | 11/1988 | Fritchman | 417/312 |
| 4,784,583 | 11/1988 | Bar | 417/312 |
| 4,911,619 | 3/1990 | Todescat et al. | 417/312 |
| 4,960,368 | 10/1990 | Lilie | 417/312 |
| 5,201,640 | 4/1993 | Heinzelmann et al. | 417/312 |
| 5,207,564 | 5/1993 | Fritchman | 417/312 |
| 5,224,840 | 7/1993 | Dreiman | 417/312 |
| 5,238,370 | 8/1983 | DiFlora | 181/403 |
| 5,304,044 | 4/1994 | Wada et al. | 417/312 |

FOREIGN PATENT DOCUMENTS

| | | | |
|---|---|---|---|
| 0195486 | 9/1986 | European Pat. Off. | 417/312 |
| 0068780 | 3/1988 | Japan | 417/312 |
| 3-290072 | 12/1991 | Japan | 417/312 |
| 4-72474 | 3/1992 | Japan | 417/312 |
| 2277355 | 10/1994 | United Kingdom | 417/312 |

*Primary Examiner*—Peter Korytnyk
*Attorney, Agent, or Firm*—Burns, Doane, Swecker & Mathis, L.L.P.

[57] ABSTRACT

A compressor includes a motor for reciprocating a piston which sucks-in refrigerant through an inlet, and discharges compressed refrigerant through an outlet. A cylinder head forms a discharge chamber communicating with the outlet, and also forms a recess disposed opposite the inlet. Mounted in the recess is a base muffler which includes a pair of elastically flexible, tapered tubes connected by a snap-in connection to a suction muffler. Refrigerant travels through the suction muffler and the base muffler to the inlet. The base muffler insulates the refrigerant from heat radiated by the motor. A capillary tube conducts oil from an oil reservoir to the base muffler for being mixed with the refrigerant.

5 Claims, 7 Drawing Sheets

REFRIGERANT COMPRESSOR HAVING INTERCONNECTED MUFFLER SECTION

BACKGROUND OF THE INVENTION

1. Field of the Invention

The present invention relates to a compressor in a heating or a cooling apparatus such as an air conditioner, refrigerator or the like by which refrigerant introduced from an evaporator can be compressed to high temperature and high pressure to thereby be discharged to a condenser.

2. Description of the Prior Art

As prior art, U.S. Pat. No. 4,759,693 is disclosed, where a compressor includes a plastic housing having first and second shells and a suction nipple extruded from plastic having a larger heat resistance than the shell, in order to solve a problematic heating of the refrigerant to a high temperature when the same is sucked because a suction passage of the refrigerant is formed in direct contact with a cylinder cover. Also, noise is generated because the refrigerant is in direct contact with the cylinder cover.

Generally, a compressor for compressing the refrigerant has been disclosed in various forms through research and development by many people in order to curb an increase of specific volume of the refrigerant, and at the same time, to increase productivity and to reduce the cost in the manufacturing of the compressor.

A representative compressor disclosed in FIGS. 1 and 2, includes a liquid-tight body 1, a stator 6 disposed within the body 1 of the compressor to form a magnetic field when an electric power is applied therefrom, a rotor 7' for being rotated by the magnetic field formed at the stator 6, a crank shaft 8 provided at the center of the rotor 7' to be rotated by the rotor 7', a connecting rod 2 for converting a rotary movement of the crank shaft 8 to a reciprocating movement, a piston 4 fixed to a tip end of the connecting rod 2 to thereby carry out a reciprocating movement for compressing refrigerant, a cylinder block 3 forming a space for guiding the piston 4 during its reciprocating movement, a valve plate 5 arranged at one end of the cylinder block 3 and in which a suction hole 5*a* and a discharge hole 5*b* are formed, and a cylinder head 7 fixed to one surface of the valve plate 5 to thereby form a suction chamber 7*a* and a discharge chamber 7*b*.

Furthermore, between the cylinder head 7 and the valve plate 5, there is inserted a gasket 9 for maintaining a fluid-tightness of the suction chamber 7*a* and the discharge chamber 7*b*.

The cylinder head 7 is formed at one side thereof with a pair of first receptible holes 7*c*, and between the first receptible holes 7*c* there is formed a second receptible hole 7*d*.

The first and second receptible holes 7*c* and 7*d* are so formed as to communicate with the suction chamber 7*a*.

The first receptible holes 7*c* are respectively fitted with a pair of connecting pipes 13, and the second receptible hole 7*d* is fitted with a plug 14 connected to a capillary tube 15.

The connecting pipe 13 is made of a thin plate of steel, with the other ends thereof respectively inserted into suction mufflers 10, whereby the flow of the refrigerant is so guided that the refrigerant supplied to the suction muffler 10 through a refrigerant inducement pipe (not shown) can be sucked into the suction chamber 7*a* formed at the cylinder head 7 through the pipes 13.

The other end of the capillary tube 15 is disposed at a lower area of the body 1 of the compressor, so that oil stored at the lower area of the body 1 of the compressor is supplied to the cylinder block 3 or the like.

In the conventional compressor thus constructed, when an electric power is supplied to the compressor, a magnetic field is formed at the stator 6, and the rotor 7' is rotated by the magnetic field.

The crank shaft 8 is rotated in cooperation with the rotation of the rotor 7', and the rotary movement of the crank shaft 8 is converted to reciprocating movement by the connecting rod 2.

The piston 4 reciprocates within the cylinder block 3 according to the reciprocating movement of the connecting rod 2. At this time, when the piston 4 is driven in the direction of arrow "A" as illustrated in FIG. 1, the refrigerant drawn into the suction chamber 7*a* of the cylinder head 7 through the suction muffler 10 and the connecting pipe 13 enters the cylinder block 3 through the suction hole 5*a* formed in the valve plate 5.

Meanwhile, when the piston 4 is driven in direction B, the refrigerant, compressed to high pressure and high temperature by a compressing movement of the piston 4 in the cylinder block 3, is discharged into the discharge chamber 7*b* of the cylinder head 7 through the discharge hole 5*b*.

At this time, the refrigerant passing through the connecting pipe 13 soars in temperature due to the heat radiated from the stator 6 and the rotor 7' disposed at the body 1 of the compressor, and the refrigerant drawn into the suction chamber 7*a* of the cylinder head 7 has its specific volume increased.

In other words, there is a problem in that, because the connecting pipe 13 is made of steel material of high heat conductivity, the high temperature heat coming from inside of the body of the compressor is transferred to the refrigerant, to thereby increase the temperature of the refrigerant flowing in the connecting pipe 13, and to over-saturate the refrigerant and to increase the specific volume of the refrigerant.

Furthermore, there is another problem in that, due to the specific volume of the refrigerant passing through the connecting pipe 13, the circulated quantity of the refrigerant is decreased and compression efficiency is reduced to thereby decrease cooling efficiency and at the same time, to reduce the energy efficiency.

There is another problem in that, because the plug 14 inserted into the second receptible hole 7*d* of the cylinder head 7 is connected to the capillary tube 15 by welding or the like, the manufacturing cost is increased and manufacturing productivity is reduced.

There is still another problem in that, because the plug 14 and the capillary tube 15 are integrally combined by the welding or the like, the amount of vacuum in the suction chamber 7*a* at the cylinder head 7 cannot be measured.

SUMMARY OF THE INVENTION

The present invention is disclosed to solve the aforementioned problems, and it is an object of the present invention to provide a compressor by which the increase in specific volume of the refrigerant sucked into a cylinder block can be reduced, thereby increasing a compression efficiency remarkably.

It is another object of the present invention to provide a compressor wherein a manufacturing cost of the compressor can be reduced to thereby increase the manufacturing productivity, and wherein the amount of vacuum in a suction chamber can be easily measured.

In accordance with the objects of the present invention, there is provided a compressor, the compressor comprising:

a body of the compressor;

compression means having a cylinder block for being disposed in the body of the compressor in order to compress absorbed refrigerant of low pressure and of low temperature to the refrigerant of high pressure and high temperature and a piston disposed within the cylinder block for reciprocating movement;

an electric motor employing a rotor and a stator for causing a piston disposed in the cylinder block of the compression means to carry out linear and reciprocating movements through a crank shaft and a connecting rod;

a valve plate formed thereon with a discharge hole and a suction hole so that the refrigerant compressed in the high temperature and high pressure in the cylinder block can be discharged or the refrigerant in low temperature and low pressure in the cylinder block can be absorbed;

a cylinder head for being fixed to the valve plate with a gasket as a medium to thereby be formed at an inner surface thereof with a discharge chamber and a receptible groove into which a base unit of the base plate is inserted to thereby be fixed by a fastening member;

a base muffler for being inserted into the receptible groove of the cylinder head to thereby interdict transmission of the heat radiated from the electric motor;

a suction muffler for attenuating noises generated according to flow of the refrigerant of low pressure and low temperature sucked thereinto by being combined with the base muffler.

According to the compressor thus constructed, the heat radiated from an electric motor employing a rotor and a stator disposed at a body thereof is prevented from being transmitted to the refrigerant passing through a suction muffler by a base muffler, so that the specific volume of the refrigerant is curbed to thereby cause the refrigerant to be circulated in much more quantity for better compression efficiency. According to the compressor thus constructed, an assembly thereof is easy to make, thereby reducing the manufacturing cost, and at the same time, to improve manufacturing productivity.

BRIEF DESCRIPTION OF THE DRAWINGS

For a better understanding of the nature and objects of the invention, reference should be made to the following detailed description taken in conjunction with the accompanying drawings in which.

DETAILED DESCRIPTION OF A PREFERRED EMBODIMENT OF THE INVENTION

An embodiment of the present invention will now be described in detail with reference to the accompanying drawings.

Figure 1:
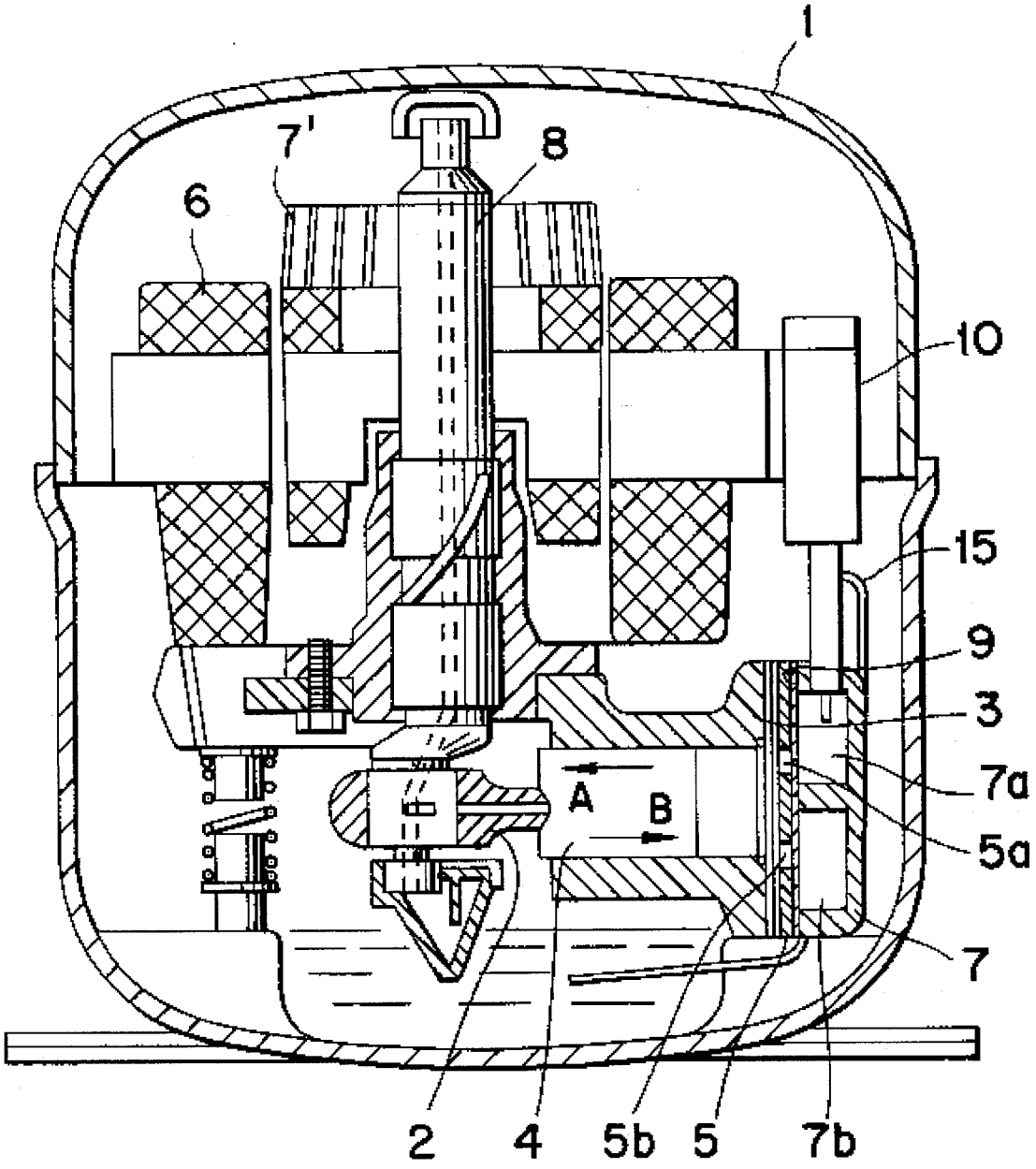
FIG. 1 (PRIOR ART)
FIG. 1 is a schematic diagram for illustrating the interior of a conventional compressor.
Figure 2:
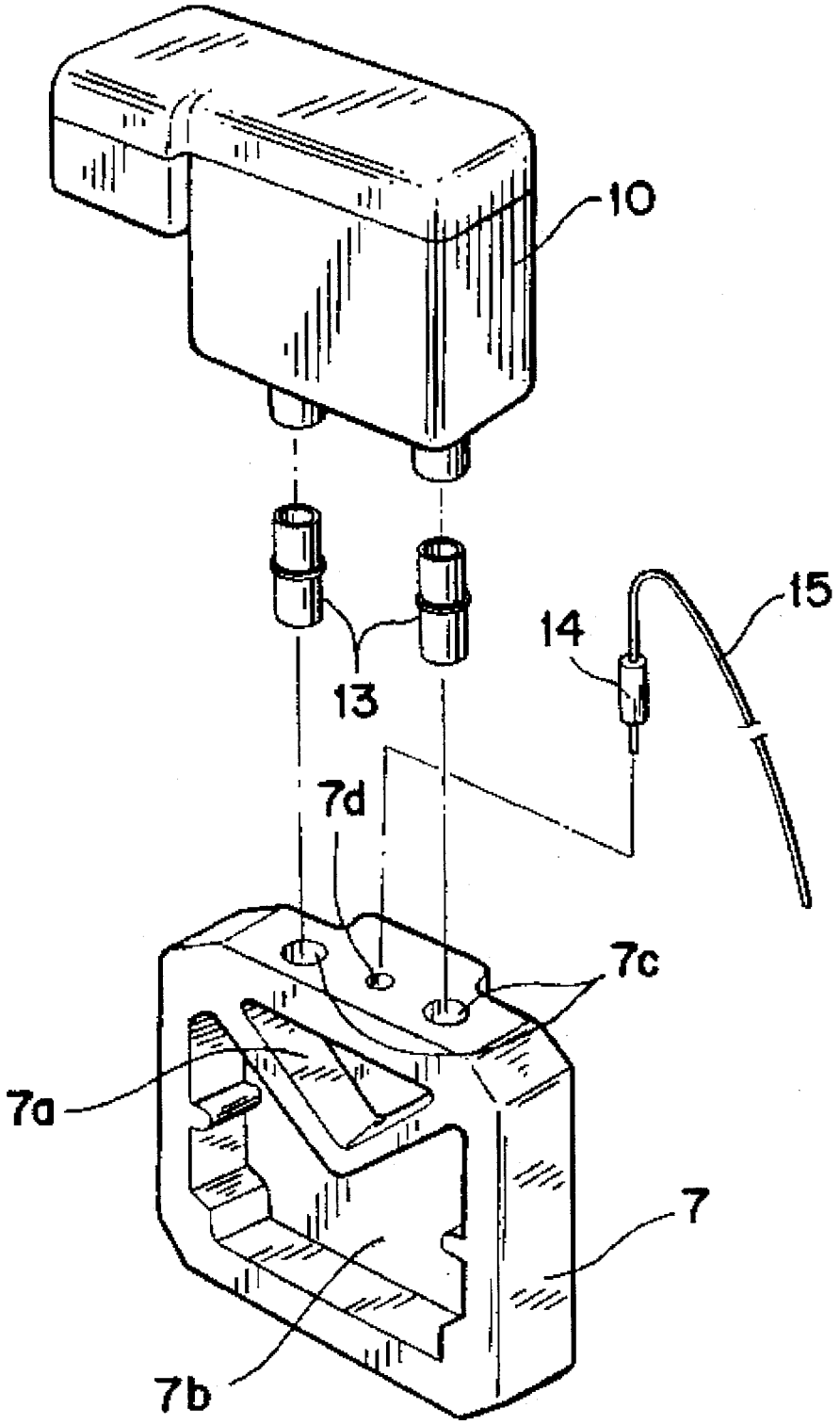
FIG. 2 (PRIOR ART)
FIG. 2 is a schematic diagram for illustrating an exploded view of some elements of the conventional compressor.
Figure 3:
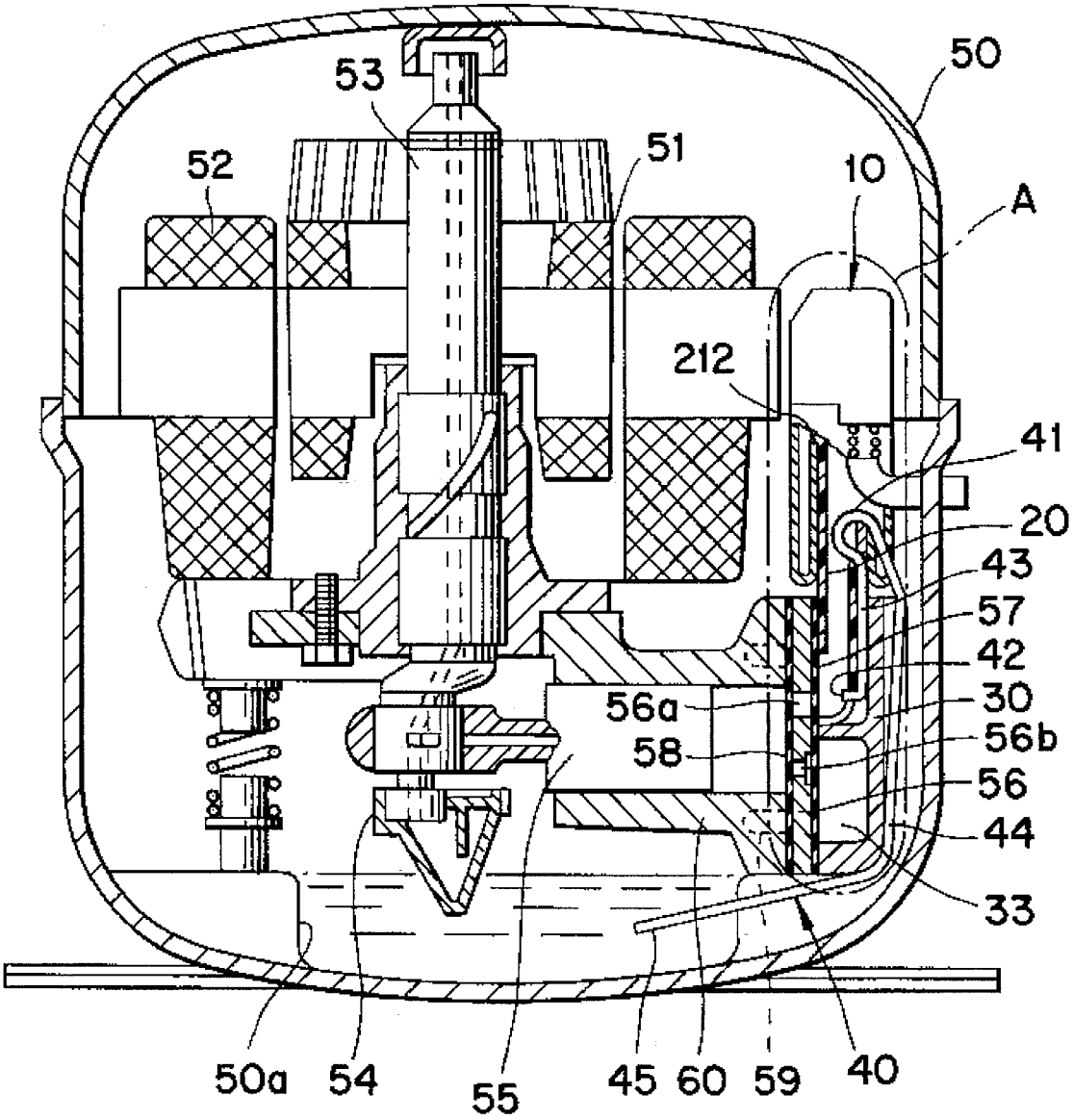
FIG. 3 is a schematic diagram for illustrating the interior of a compressor according to the present invention.
Figure 4:
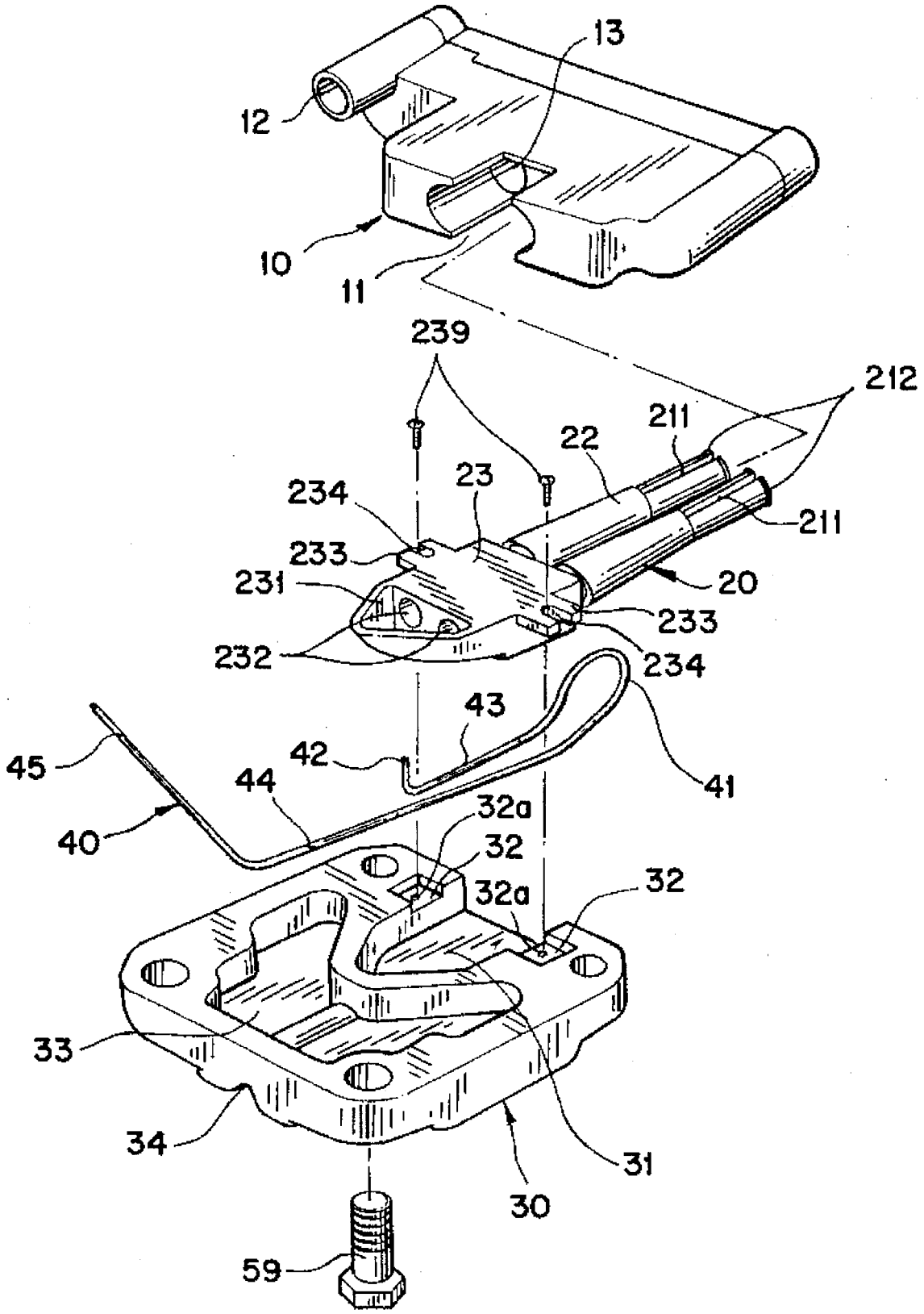
FIG. 4 is an exploded perspective view of some elements of the compressor according to the present invention.

As illustrated in FIGS. 3 and 4, a compressor includes a stator 52 disposed within a body to form a magnetic field when electric power is applied from a power supply source (not shown), a rotor 51 for being rotated by the magnetic field, a crank shaft 53 for being rotated by the rotor 51, a connecting rod 54 connected to one end of the crank shaft 53 to thereby convert a rotary movement of the crank shaft 53 to reciprocating movement, a piston 55 connected to the other end of the connecting rod 54 to thereby carry out a reciprocating movement, and a cylinder block 60 for guiding the piston 55 for reciprocating movement.

In the aforesaid description, the cylinder block 60 and piston 55 define compressing means for compressing a low pressure and low temperature refrigerant to high pressure and high temperature. The stator 52 and the rotor 51 rotatively disposed in the stator 52 constitute an electric motor.

Furthermore, a valve plate 56 formed with a discharge hole **56*b* and a suction hole 56*a* is attached to the cylinder block by fasteners 59, with sealing gaskets 57, 58 disposed on opposite sides of the valve plate. A cylinder head 30 is attached against the gasket 57**.

The cylinder head 30 has an inner side surface formed with (i) a discharge chamber 33 for conducting the refrigerant compressed to high pressure and high temperature by the piston 55 in the cylinder block 60, and (ii) a receptible groove 31 on which a base unit 23 of a base muffler 20 is seated, The cylinder head 30 has an outer side surface formed with a groove 34 for easily fixing therein a capillary tube 40.

The groove 31 formed in the cylinder head is provided at each of its sides with a concave groove 32 for being fitted with a respective protrusion 233 of the base muffler 20, and each concave groove 32 is formed with a hole **32*a***.

Meanwhile, as illustrated in FIG. 4, the suction muffler 10 serves to attenuate the noise generated by the flow of the low-temperature and low-pressure refrigerant sucked by an evaporator (not shown). The suction muffler 10 includes a suction hole 12 for sucking in the refrigerant, a recess 11 for accepting the base muffler 20, and clamping grooves 13 formed at an inner tip end of the recess 11.

Furthermore, between the suction muffler 10 and the cylinder head 30, there is disposed the base muffler 20 for interdicting a transfer of the heat radiated from the stator 52 and the rotor 51, and at the same time, for guiding the flow of the refrigerant so that the refrigerant that has passed the suction muffler 10 can be sucked into the cylinder block 60 through the suction hole **56*a* formed in the valve plate 56**.

The suction muffler 10 includes (i) the suction hole 12 for sucking refrigerant gas of low pressure and low temperature circulating through a refrigerant cycle, and (ii) the recess 11 which is fitted with suction tubes 22 of the base muffler 20 so that the low temperature and low pressure refrigerant induced from the suction hole 12 can be guided to a suction chamber 231 of the base muffler 20.

The base muffler 20 is injection-molded of such material as plastic or the like having a relatively low coefficient of heat transfer, to guide the flow of the refrigerant which has passed the suction muffler 10, and at the same time the heat radiated from the stator 52 and the rotor 51 can be prevented from being transferred to the refrigerant. The base muffler 20 includes a base unit 23 for storing oil sucked through the suction tubes 22, and at the same time for fixing the base muffler 20 to the cylinder head 30.

Furthermore, each suction tube 22 of the base muffler 20 is formed along a longitudinal direction thereof with a slit 211 so that the tube can be easily inserted into the recess 11 of the suction muffler 10. Each suction tube 22 is also formed at a tip end thereof with a click or snap-in projection 212 meshing into a respective clamping groove 13 formed at the suction muffler 10 so that the tube can be tightly fixed to the suction muffler 10 with no swaying whatsoever after being inserted into the recess 11.

In the afore-referenced description, the slit 211 formed in the suction tube 22 of the base muffler 20 creates an elastic region of the tube, enabling the suction tube 22 to be more easily inserted into the recess 11 of the suction muffler 10.

Each suction tube 22 of the base muffler 20 is formed with a tapering shape in order to regulate the distance by which the suction tube can be inserted into the recess 11, and at the same time, to make possible an easy connection thereto.

The base unit 23 of the base muffler 20 includes a refrigerant hole 232 for guiding the flow of the refrigerant. A pair of protruding ears 233 form nut fixing grooves 234 and are received by the concave grooves 32 formed at the sides of the suction chamber 31 in the cylinder head 30. The ears are fastened to holes **32*a* formed in the concave grooves 32 by fastening members 239. A suction chamber 231 is provided in the base unit for (i) blocking the heat so that an increase of specific volume of the refrigerant introduced through the refrigerant guide hole 232 can be curbed, and (ii) for guiding the refrigerant into the cylinder block 60 through the suction hole 56*a* formed in the valve plate 56**.

Figure 5:
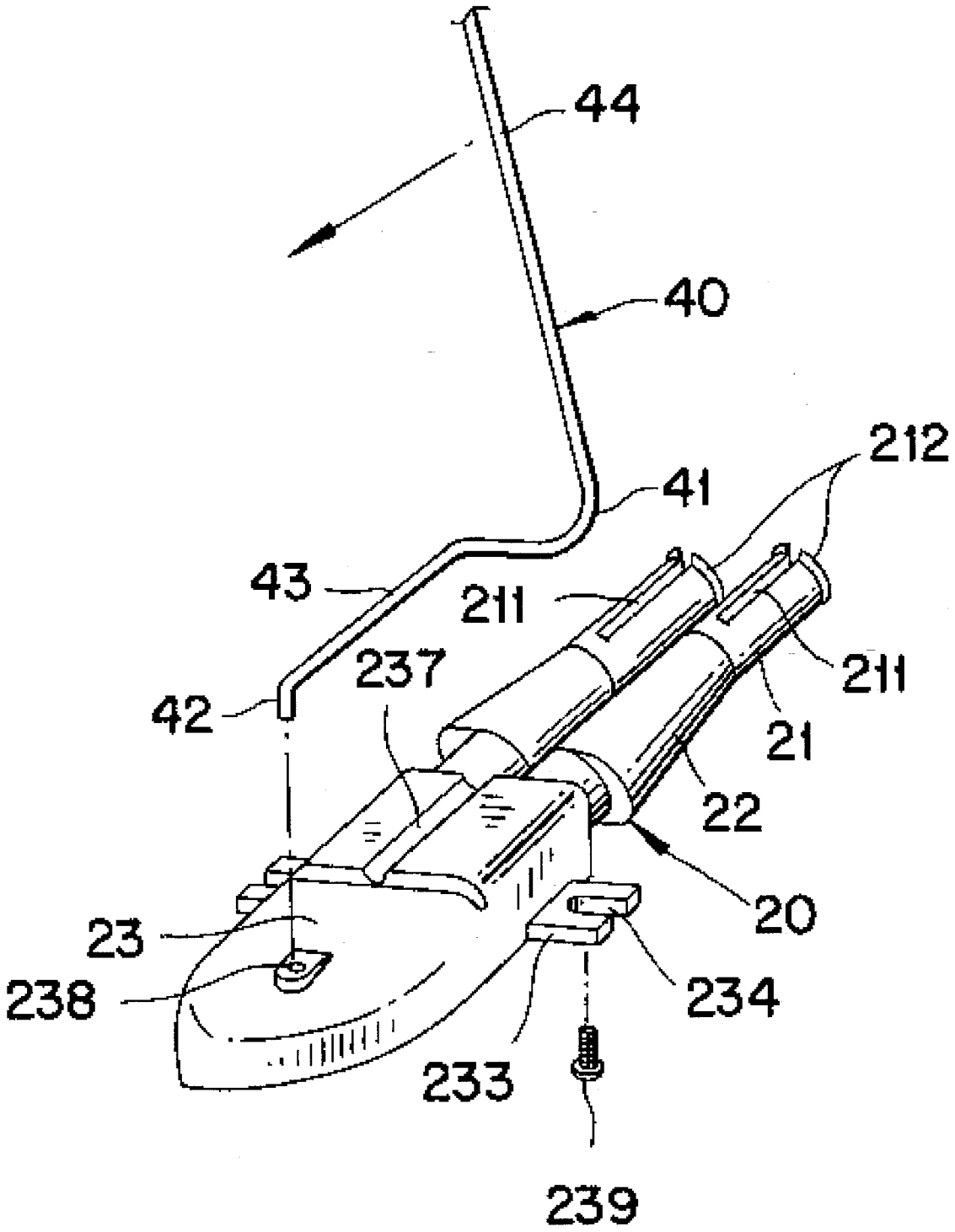
FIG. 5 is a perspective view for illustrating a base muffler and a capillary member of the compressor according to the present invention.

Furthermore, as illustrated in FIG. 5, the base unit 23 of the base muffler 20 is provided at the other surface thereof with a groove 237 which receives part of the capillary tube 40 (described later), and a receptible hole 238 for receiving one end of the capillary tube 40.

Meanwhile, the capillary tube 40 serves to suck by capillary action the oil stored in an oil chamber **50*a* formed at a lower area of the body 50 of the compressor, to thereby supply the oil into the cylinder block 60. The capillary tube 40 includes a tip end 42 which is bent to be easily inserted into a receptible hole 238 formed at the base unit 23 of the base muffler 20, and a first flat portion 43 connected to the tip end 42 to be received in the groove 237 formed in a rear surface of the base muffler 20. A bent part 41 of the tube 40 joins the first flat portion 43 to a second flat portion 44 received in a guide groove 34 of the cylinder head 30. A third flat portion 45 is folded or bent at a junction with the second flat portion 44 and dips into the oil chamber 50*a***.

The capillary tube 40 thus serves to conduct the oil by way of a capillary action, to supply the oil into the cylinder block 60 and form an oil film thereon to carry out a lubrication and cooling action.

Next, an assembly sequence of principal parts of the compressor according to the present invention thus described will be explained.

First of all, the cylinder block 60 is sequentially attached to the gasket 58, suction valve (not shown) and the valve plate 56 in that order.

As illustrated in FIG. 5, the receptible hole 238 formed at the base muffler 20 tightly receives the tip end 42 of the capillary tube 40, to thereby cause the tip end 42 to join the suction chamber 231 of the base muffler 20, and the first flat portion 43 of the capillary tube 40 is caused to enter the groove 237 formed in the base muffler 20.

Figure 7:
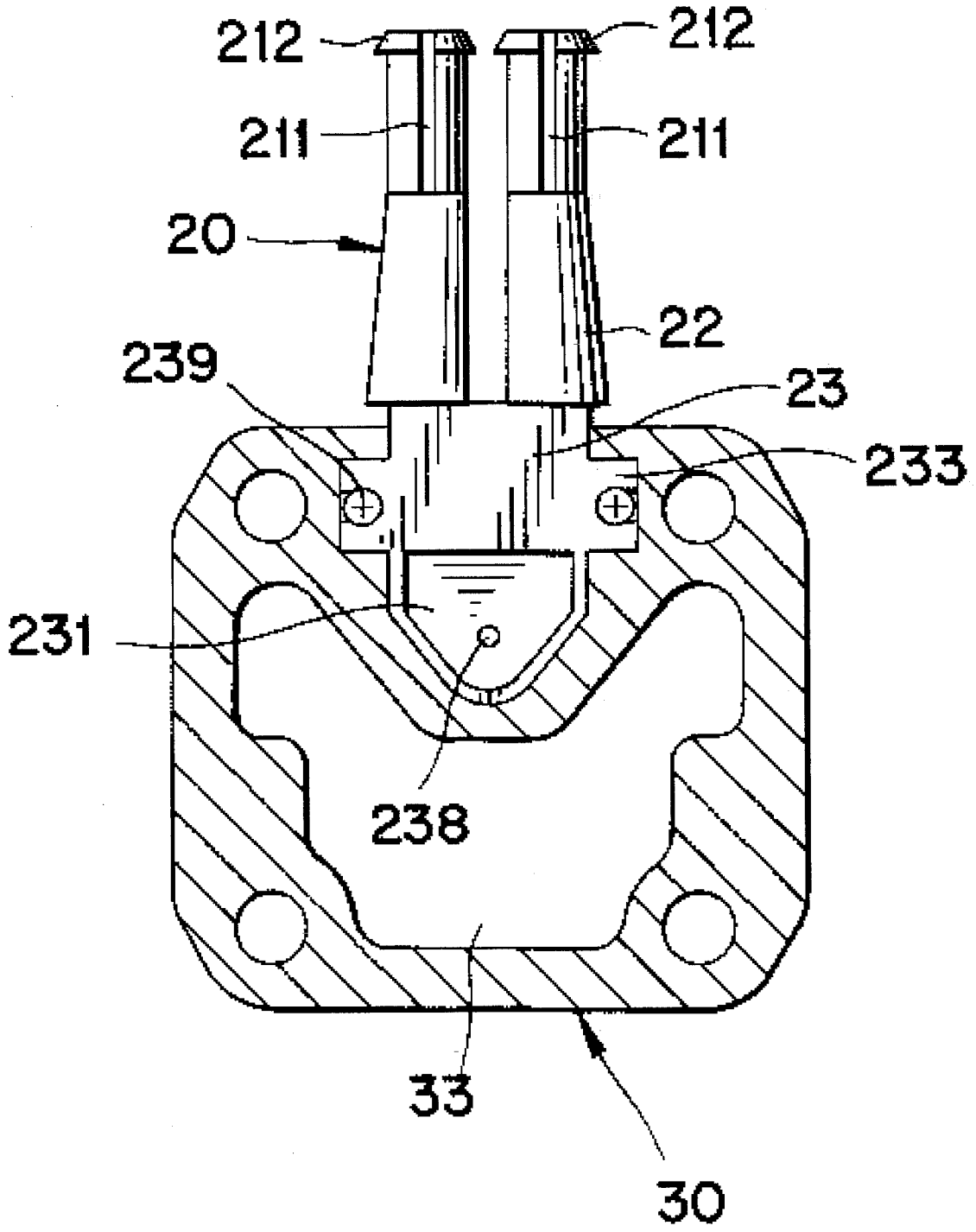
FIG. 7 is a rear elevation for illustrating a rear surface of FIG. 6.

Furthermore, when the first flat portion 43 of the capillary tube 40 enters the groove 237, as illustrated in FIG. 7, the ears 233 formed on the base unit 23 of the base muffler 20 are inserted into the concave grooves 32 of the cylinder head 30. Then the base muffler 20 and the cylinder head 30 are fastened together by the fastening members 239.

Because the base muffler 20 and the cylinder head 30 are combined by the fastening members 239, the base unit 23 of the base muffler 20 is fixedly positioned in the receptible groove 31 of the cylinder head 30, and at the same time, the first flat portion 43 of the capillary tube 40 is inserted into the groove 237 and thus is prevented from swaying.

Furthermore, after the cylinder head 30 and the base muffler 20 are combined, the capillary tube 40 is bent in direction C to thereby form the bent part 41, as illustrated in FIG. 5, so that the second flat portion 44 of the capillary tube 40 can be inserted into the guide groove 34 of the cylinder head 30.

Then, the cylinder head 30, gasket 57 and the valve plate 56 are sequentially fixed in their positions and are joined to the cylinder block 60 by fastening means 59.

Figure 6:
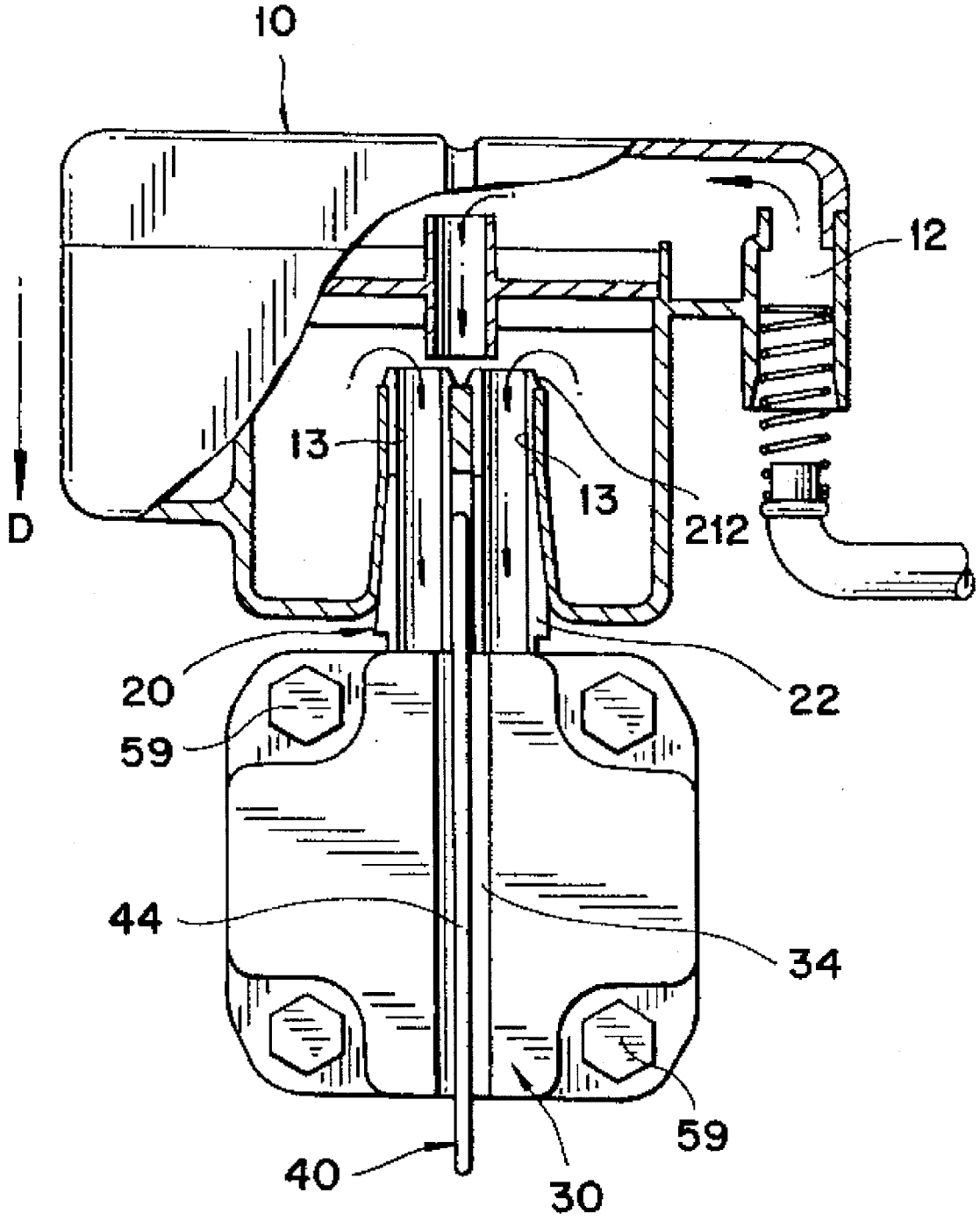
FIG. 6 is a sectional view for illustrating the interior of part A in FIG. 3.

Next, the suction chamber 231 formed in the base muffler 20 is connected to a silicon hose equipped with a vacuum gauge (not shown) via one of the two suction tubes 22 of the base muffler 20, and the other suction tube 22 is closed. The compressor is activated to thereby measure the amount of vacuum in the suction cylinder 30, i.e., to measure the amount of vacuum in the suction chamber 231 of the base muffler 20. When the vacuum in the suction chamber 231 exceeds a predetermined level, the suction muffler 10 is moved in direction D to cause the suction tubes 22 of the base muffler 20 to enter the recess 11, as illustrated in FIG. 6, thereby joining the suction muffler 10 with the base muffler 20.

Because the slits 21 formed in the suction tubes 22 of the base muffler 20 define elastic regions, the suction muffler 10 and the base muffler 20 can be easily combined.

Because projections 212 formed at a front tip end of the suction tube 22 of the base muffler 20 become connected to the clamping grooves 13 of the suction muffler 20, the suction muffler 10 is securely joined to the base muffler 20.

Meanwhile, because each suction tube 22 of the base muffler 20 is formed with a tapering shape, the suction muffler 10 and the base muffler 20 are tightly secured.

The compressor according to the present invention enables the vacuum in the suction chamber 231 to be easily measured, and because there is no need for employing components such as plugs and the like as in the conventional compressor, the manufacturing cost can be reduced due to the need for a fewer number of components. Because there is no need for processes such as welding and the like, manufacturing productivity can be markedly improved.

In the aforesaid description, although a preferred embodiment of the invention has been disclosed for explaining an assembly sequence of a compressor according to the present invention, it should be apparent that a change of the assembly sequence according to convenience thereof would not depart from the scope and spirit of the invention.

Now, the operation of the compressor according to the embodiment of the present invention will be described.

First of all, when an electric power is applied to the stator 52 of the electric motor from an electric power source (not shown), a magnetic field is formed at the stator 52, and the rotor 51 of the electric motor is rotated by the magnetic field.

The crank shaft 53 is now rotated in cooperation with the rotation of the rotor 51.

Furthermore, the rotational movement of the crank shaft 53 is converted to reciprocating movement by the connecting rod 54, and the piston 55 starts to reciprocate.

The refrigerant, which has been changed to a state of low temperature and low pressure by way of the evaporating action of an evaporator (not shown), is sucked into the body 50 of the compressor as the piston starts to reciprocate, and the refrigerant sucked into the body 50 of the compressor enters the suction muffler 10 through the suction hole 12.

The refrigerant sucked into the suction muffler 10, as illustrated in FIG. 6, flows into the cylinder block 60 through the base muffler 20 and through the suction hole 56*a* of the valve plate 56.

At this time, because the base muffler 20 is injection-molded of plastic material having a relatively low coefficient of heat transfer, the transfer of heat from the stator 52, the rotor 51 and the like to the refrigerant passing through the base muffler 20 is minimized.

Furthermore, because the suction chamber 231 of the base muffler 20 is disposed within the cylinder head 30 and the base unit 23, the transfer of radiant heat from the electric motor (defined by the stator 52 and the rotor 51) to the refrigerant in the suction chamber 231 is minimized.

Accordingly, the heat radiated from the electric motor or the like is blocked by the cylinder head 30 and the base muffler 20 from being transferred to the refrigerant which has passed the suction muffler 10, to minimize any increase of the specific volume of the refrigerant and to thereby increase a compression efficiency of the refrigerant remarkably.

Still furthermore, the circulation of the refrigerant is smoothly realized, to increase the compression efficiency of the compressor for markedly improving the cooling capability.

Meanwhile, during reciprocating movement of the piston 55, the oil stored in the lower area of the body 50 of the compressor is smoothly supplied into the cylinder block 60 through the capillary tube 40, thereby causing an oil film to be formed between the piston 55 and the cylinder block 60, so that lubrication and cooling functions can be effectively carried out.

Because the base muffler is injection-molded of plastic material of low coefficient of heat transfer, and a suction chamber of the base muffler is defined by both by the cylinder head and the base unit of the base muffler, the refrigerant is insulated from heat radiated from the electric motor to thereby increase the circulated quantity of the refrigerant and to minimize any increase of specific volume of the refrigerant, for achieving improved compression efficiency.

At the same time, the manufacturing cost of the compressor is reduced to thereby increase manufacturing productivity.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

I claim:

1. A compressor comprising:

a body;

compression means having a cylinder block for being disposed in the body of the compressor in order to compress sucked-in refrigerant of low pressure and low temperature to a high pressure and high temperature, and a piston disposed within the cylinder block for reciprocating movement;

an electric motor including a rotor and a stator connected by a crank shaft and a connecting rod to a piston disposed in the cylinder block of the compression means for displacing the piston in linear reciprocating movements;

a valve plate formed with a discharge hole and a suction hole so that the refrigerant compressed to high temperature and high pressure in the cylinder block can be discharged, and so that the low temperature and low pressure refrigerant in the cylinder block can be sucked-in;

a cylinder head fixed to the valve plate with a gasket disposed therebetween, said cylinder head formed at an inner surface thereof with a discharge chamber and a receptible groove;

a base muffler mounted in the receptible groove of the cylinder head to thereby interdict the transfer of the heat radiated from the electric motor; and a suction muffler for attenuating noises generated by a flow of low pressure and low temperature refrigerant sucked thereinto;

the base muffler including a suction tube insertable into a recess of the suction muffler for connecting the suction muffler to the base muffler, the suction tube including a longitudinal slit formed therein to render the suction tube elastic for easier insertion into said recess, and the suction tube being tapered to limit the distance to which the suction tube can be inserted into the recess.

2. A compressor for compressing refrigerant, comprising:

a body;

an electric motor disposed in said body;

a cylinder block disposed in said body;

a valve plate disposed at one end of said cylinder block and forming a refrigerant inlet and a refrigerant outlet;

a piston mounted for reciprocation in said cylinder block for sucking-in refrigerant through said inlet during a suction stroke, and then compressing the sucked-in refrigerant for discharge through said outlet during a compression stroke;

a cylinder head mounted at a side of said valve plate facing away from said cylinder block and forming a discharge chamber communicating with said outlet, and also forming a groove disposed opposite said inlet;

a base muffler mounted in said groove and forming a first refrigerant passage communicating with said inlet; and a suction muffler attached to said base muffler and forming a second refrigerant passage for conducting refrigerant to said first refrigerant passage, said suction muffler attenuating noise generated by a flow of refrigerant, wherein the first passage includes a tube insertable into a recess of said suction muffler, said tube including a longitudinal slit for making said tube elastically deformable, and said tube being tapered to regulate a distance of insertion thereof into said recess.

3. The compressor according to claim 2, wherein said tube includes a snap-in projection for locking said tube in said recess.

4. The compressor according to claim 2, wherein there are two of said tubes situated side-by-side, said tubes being installable in said recess by a snap-in connection.

5. The compressor according to claim 2, wherein said base muffler includes projections received in recesses of said cylinder head, and fasteners extending through said projections and connectible to said cylinder head for connecting said base muffler to said cylinder head, said base muffler including a suction chamber communicating with said inlet, said suction chamber being insulated from heat radiated from said motor.

* * * * *